United States Patent [19]

Kemmner et al.

[11] 4,128,365

[45] Dec. 5, 1978

[54] FUEL SUPPLY UNIT

[75] Inventors: Ulrich Kemmner, Sachsenheim; Karl Ruhl, Gerlingen, both of Fed. Rep. of Germany

[73] Assignee: Robert Bosch GmbH, Stuttgart, Fed. Rep. of Germany

[21] Appl. No.: 792,625

[22] Filed: May 2, 1977

[30] Foreign Application Priority Data

May 3, 1976 [DE] Fed. Rep. of Germany ..... 2619094

[51] Int. Cl.[2] ..... F04B 17/00

[52] U.S. Cl. ..... 417/423 R; 417/366; 403/302; 64/2 R

[58] Field of Search ..... 417/366, 410, 423 R; 403/254, 261, 263, 301, 302; 64/10, 2 R, 1 V, 6; 415/122 R

[56] References Cited

U.S. PATENT DOCUMENTS

| | | | |
|---|---|---|---|
| Re. 29,445 | 10/1977 | Nusser et al. | 417/366 |
| 3,897,197 | 7/1975 | Fussner et al. | 412/366 |
| 3,969,044 | 7/1976 | Fussner et al. | 417/366 |

FOREIGN PATENT DOCUMENTS

| | | | |
|---|---|---|---|
| 1382731 | 2/1975 | United Kingdom | 417/366 |

*Primary Examiner*—C. J. Husar
*Attorney, Agent, or Firm*—Edwin E. Greigg

[57] ABSTRACT

A fuel supply unit is proposed wherein the pump rotor and electromotor armature are mounted independently of one another on a common fixed axis. A pin which engages in a corresponding recess in the pump rotor for entrainment purpose is provided on the motor armature.

10 Claims, 2 Drawing Figures

FUEL SUPPLY UNIT

BACKGROUND OF THE INVENTION

This invention relates to a pump-and-motor unit which is particularly adapted for supplying fuel and which comprises a pump rotor and motor armature the bearings of which are disposed independently of each other on a common fixed area.

The present invention relates to a fuel supply pump-and-motor unit of the type in which the pump rotor and motor armature are mounted on a common fixed axis provided by a longitudinally extending shaft element and include a rotation locking connection disposed between the rotor and motor armature.

In existing fuel supply units of this type the pump rotor and motor armature are mounted on a tubular element that telescopes the aforesaid shaft element. In another existing fuel supply unit, a connection bushing is disposed between the pump rotor and the motor armature; the inner bore of this connection bushing being arranged to receive a bearing which serves for both the pump rotor and the motor armature. However, it has been found that with this type of system there is excessive wear at the bearing points and also at the pump rotor, in spite of the fact that case-hardened sintered material has normally been used for the bearings. This excessive wear causes an increase in the current consumption; a reduction in the rpm, as well as the quantity of fuel supplied and ultimate pressure. This finally leads to complete failure of the fuel supply system for the internal combustion engine.

The excessive wear produced in existing pumps is due both to the poor lubricating properties of the new fuels and the relatively poor dry operating properties of the sintered bearings and also to the fact that the forces which the pump rotor and motor armature transmit to the bearings are markedly different. The pump rotor produces powerful radial forces directly on one end area of the longitudinally extending shaft whereas the motor armature produces powerful axial forces, particularly when starting up. These different stresses have been found to be especially hard on the rotating parts in the case of the rigid coupling systems of the existing fuel supply units, particularly when a common bearing is used. Marked radial stressing of the rotor produces radial wear of the associated bearings and, as a result, the motor armature can no longer operate concentrically which adversely affects the wear of the bearing disposed at the opposite end of the motor armature and also causes unilateral wear of the collector and irregular distribution of the magnetic forces. The axial forces of the motor armature on the pump rotor also cause a high degree of friction and corresponding wear between the rotor and the adjacent axial limiting wall of the pump.

Another disadvantage of the existing fuel supply units consists in that it is difficult to mount the corresponding parts, some of which fit in one another particularly since in some units the parts are pressed in succession into the cup-shaped unitized housing. As the housing acts as a support or guide for all elements contained therein tolerances in the radial dimensions are a disadvantage. This is particularly the case when a part of the fuel supply unit, such as the pump or motor, must be changed.

OBJECT AND SUMMARY OF THE INVENTION

The primary object of this invention is to provide a construction in which the rotation-locking connection between the pump rotor and the motor armature comprises axially extending tenon means which engage in complementally formed recesses in the pump rotor, accordingly the forces produced on one of the two rotating parts, such as the pump rotor or motor armature, do not affect the other part which consists of the pump rotor or motor armature. Thus, unilateral wear of the bearings on one part does not adversely affect the other part and marked wear of one bearing does not cause corresponding wear of the other bearing. Since the tenons freely engage in the corresponding recesses of the pump rotor, the same degree of precision is not required in terms of the dimension tolerances of the pump and motor and for this reason the cost of manufacture of these parts is much lower. When either part such as the pump or motor has to be changed it is relatively simple to mount a new part in place. Previously if the unit could be disassembled it was necessary to match the tolerances of the old part with those of the new.

Another object of this invention is to provide an assembly in which a bushing type member that includes the offstanding tenons is rigidly associated with the winding of the motor armature.

Still another object of this invention is to provide a tubular sleeve element which telescopes the armature shaft and forms a carrier member for the novel bushing.

A further object of this invention is to provide means on the motor armature shaft which cooperate with the telescoping sleeve element to prevent axial displacement of the armature shaft.

These and other objects are attained, according to the invention, by providing a flow limiter with flow passages which are symmetric with respect to the throughput axis and which are defined at least substantially by conical surfaces acting as flow guidance surfaces.

The invention will be better understood as well as further object and advantages thereof become more apparent from the ensuing detailed description of further embodiment taken in conjunction with the drawing.

DESCRIPTION OF THE PREFERRED EMBODIMENT

Figure 1:
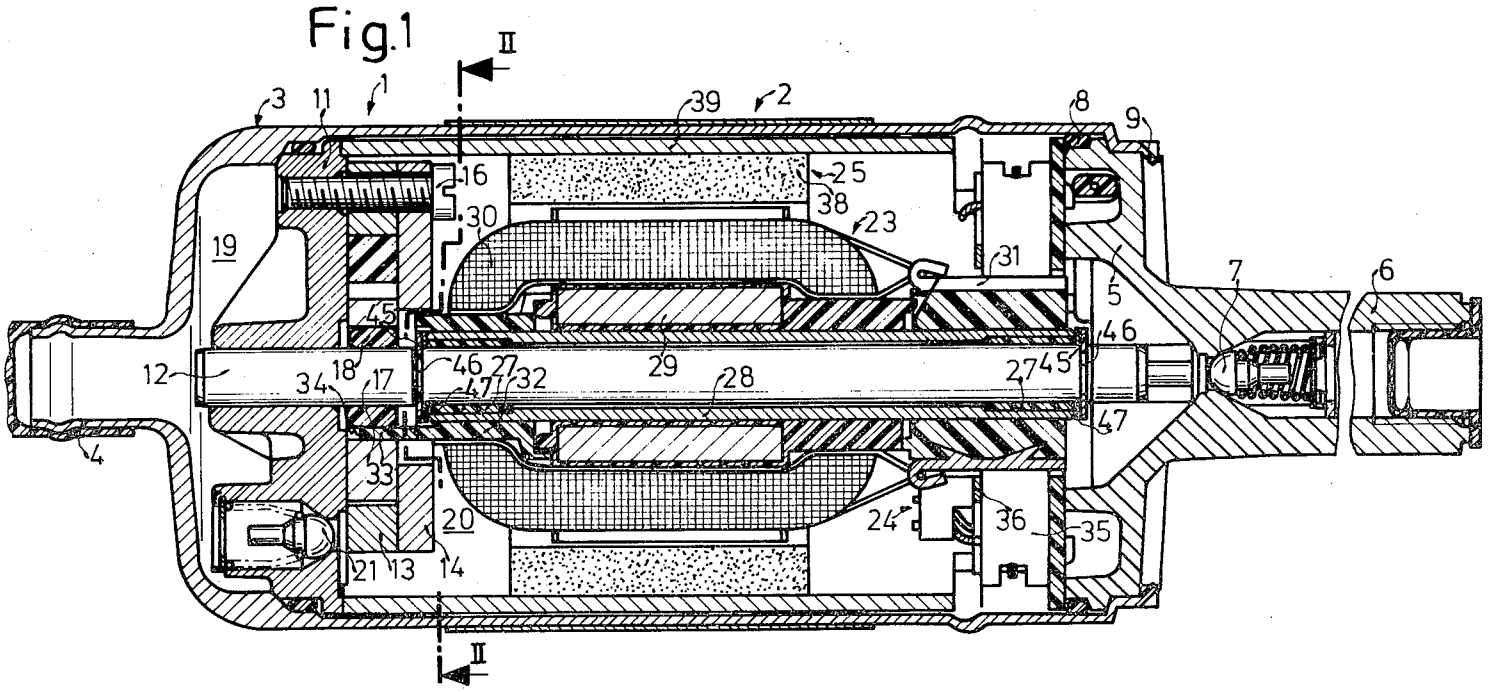
FIG. 1 is a longitudinal sectional view through the fuel supply unit according to the invention.

Turning now to the drawing the fuel supply unit includes a fuel pump 1 and an electromotor 2 which are housed in a cup-shaped housing 3 which comprises at one end a vacuum connection 4 for a fuel conduit the other end of which is closed by a perforated cap 5, on which a pressure connection socket 6 and a non-return valve 7 that serves as a check valve, are mounted. A packing 8 is disposed between the housing 3 and the cap 5 as shown. The cap 5 is attached to the housing by means of bending prongs 9 provided on the open end of the housing 3.

In the housing 3 to the left as viewed in the drawing — from the suction side to the pressure side — the pump 1 is disposed and then the electromotor 2. The fuel supplied under pressure by the pump 1 flows around the electromotor 2 in a known manner so as to cool the same.

The pump 1 comprises a base plate 11, into the central bore of which one extremity of the shaft 12 is press fitted. An intermediate plate 13 encompasses the pump rotor and supporting plate 14 supported on said base plate is disposed axially adjacent to the base plate 11 in abutment with the pump rotor by screws 16. The pump 1 communicates with the chamber 19 via openings on its suction side (not shown) and further includes a pressure control valve 21. The chamber 19 is confined to the end wall of the housing 3 and the base plate 11. The pressure side of the pump 1 extends to a chamber 20 which contains the electromotor 2 and communicates with the check valve 7. The connections from the pump 1 to the chambers 19 and 20 are controlled by the pump rotor but are preferably open channels.

The electromotor 2 comprises a motor armature 23, a collector 24 and a magnetic part 25.

The motor armature 23 is supported on a rigid tubular member that telescopes the shaft 12 and is provided at opposite ends thereof with journal bearings 27. As shown this tubular member provides support for the motor armature and its requisite components including the commutator bushing 31. To assemble these elements they are attached partly by pressure and partly by means of plastic filler means which, after spraying of the individual elements, ensure a good rotation-locking axial connection.

A bushing 32 or sleeve of this invention is disposed on the telescoping tubular member 28 on the side that confronts the pump and engages in the manner of a rotating coupling comprising at least one axially extending tang 33 which is received in a corresponding recess 34 in the rotor 17.

The commutator brushes 35, which are disposed in cage elements 36, are arranged to slide on the commutator bush 31. The cage elements 36 are connected with connection clamps (not shown) that are disposed outside the housing 3.

Figure 2:
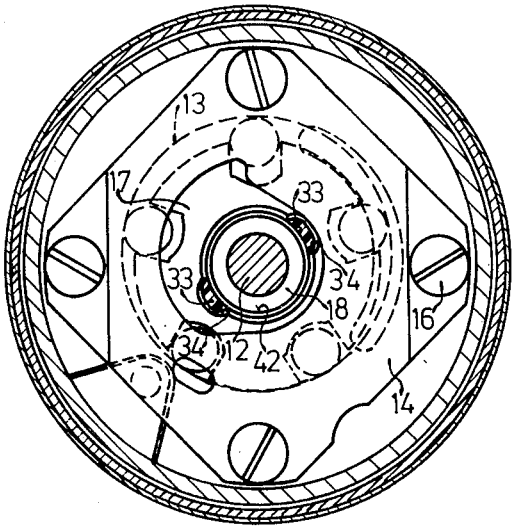
FIG. 2 is a section along the line II—II in FIG. 1.

The magnetic part 25 of the electromotor 2 includes a permanent magnet 38 which is disposed in a tubular sheet 39 made of a magnetically conducting material Referring now to FIG. 2 the bushing or sleeve 32 is provided with at least one axially extending tenon that engage into recesses 34 included in the pump rotor. The tenons 33 comprise a certain amount of clearance with respect to the recess 34 to avoid a rotation-locking connection in the event of slight tolerance differences. A rotation-locking connection is only to be produced for the reasons cited initially by means of the two tenons 33 and the recesses 34. The advantage of the play provided is that when the journal bearing 18 expands, the material which is displaced can move into the recess 34, thereby substantially improving the radial connection between the journal bearing 18 and the pump rotor 17. To prevent the axial forces from the motor armature 23, more particularly, the starting forces, from being transmitted to the pump rotor 17, circlips 45 are provided on the axis 12. These engage in corresponding annular grooves 46. The end faces of the journal bearings 27 of the motor armature 23 abut supporting disks 47 which are in turn, supported adjacent the circlips 45.

The invention is not restricted only to fuel supply units in which the pump rotor is in the form of a disk, but it can also be used with lateral channel pumps wherein a fixed housing part is disposed opposite a rotating part and the pump work chamber is disposed between these two parts which are displaceable relative to one another.

The invention can also be used in pumps wherein a common bearing is provided for the pump rotor and motor armature and wherein this bearing is not designed to form a rotation-locking or force-locking connection involving the initially cited disadvantages.

What is claimed is:

1. A fuel supply unit comprising a pump having a rotor and an electromotor having an armature, a rigid mounting shaft common to said pump rotor and said electromotor armature, first bearing means for rotatably mounting said pump motor on said shaft, second bearing means for rotatably mounting said armature on said shaft, independently of said pump rotor, axially extending tenons connected with said motor armature, means for supporting said tenons on said armature in rotation-locking connection with said pump rotor and thereby serve as the only means for coupling said armature and said rotor together.

2. A fuel supply unit as claimed in claim 1, in which said tenons are integral with said supporting means.

3. A fuel supply unit as claimed in claim 2, in which said means supporting said tenons is disposed rigidly relative to windings of said armature.

4. A fuel supply unit as claimed in claim 1, in which said supporting means is press-fitted to a tubular member which telescopes said armature shaft.

5. A fuel supply unit as claimed in claim 3, in which said motor armature and said means supporting said tenons are encapsulated in plastic.

6. A fuel supply unit as claimed in claim 1, in which said tenons have a greater extent in a circumferential direction than in a radial direction.

7. A fuel supply unit as claimed in claim 1, in which further means are associated with said motor armature and said shaft to restrict axial movement thereof.

8. A fuel supply unit as claimed in claim 7, in which said restrictive movement of said shaft and said motor armature is achieved by providing longitudinally spaced grooves in said shaft and positioning retainer means therein.

9. A fuel supply unit comprising a pump having a rotor and an electromotor having an armature, a rigid mounting shaft, to said pump and said electromotor armature, first bearing means for rotatably mounting said pump rotor on said shaft, second bearing means independent of said first bearing means for rotatably mounting said armature on said shaft, independently of said pump rotor, axially extending tenons connected with said motor armature, means for supporting said tenons on said armature in rotation-locking connection with said pump rotor and thereby serve as the only means for coupling said armature and said rotor together, said pump rotor bearing means including a ring means that is displaceable relative to said shaft and is arranged to be received in a bore in said pump rotor.

10. A fuel supply unit as claimed in claim 9, in which said bore includes radial recesses for entry of said tenons.

* * * * *